United States Patent [19]

Awano et al.

[11] Patent Number: 4,713,020

[45] Date of Patent: Dec. 15, 1987

[54] CONNECTOR UNIT

[75] Inventors: Yoshiyuki Awano, Kawasaki; Hiroshi Narita, Tokyo, both of Japan

[73] Assignee: E. I. Du Pont de Nemours and Company, Wilmington, Del.

[21] Appl. No.: 8,272

[22] Filed: Jan. 29, 1987

[51] Int. Cl.[4] ..... H01R 9/07

[52] U.S. Cl. ..... 439/267; 439/268; 439/495

[58] Field of Search ..... 339/75 R, 75 M, 75 MP, 339/74 R, 176 M, 176 MP, 176 MF, 17 F

[56] References Cited

U.S. PATENT DOCUMENTS

| | | | |
|---|---|---|---|
| 3,989,336 | 11/1976 | Rizzio, Jr. et al. | 339/75 MP |
| 4,449,773 | 5/1984 | Esser et al. | 339/74 R |
| 4,480,886 | 11/1984 | Bergamin | 339/75 MP |
| 4,519,133 | 5/1985 | Pansanel | 339/75 MP |
| 4,519,660 | 5/1985 | Ichimura et al. | 339/75 M |
| 4,560,222 | 12/1985 | Dambach | 339/75 MP |
| 4,580,867 | 4/1986 | Wright et al. | 339/176 MF |
| 4,629,271 | 12/1986 | Awano | 339/75 MP |
| 4,647,131 | 3/1987 | Van Woensel | 339/74 R |

*Primary Examiner*—John McQuade

[57] ABSTRACT

A connector unit is provided which includes a housing having connection terminals in its opening, and a movable member adapted to be inserted into the opening of the housing. The movable member has cam projections each extending from one end, where the movable member is inserted into the housing, toward the other end, over a proper length. When the movable member is partially inserted into the opening of the housing, an elastic contact portion of the connection terminal is pressed by the cam projection to provide such a clearance as to allow the conductor to be inserted there.

1 Claim, 9 Drawing Figures

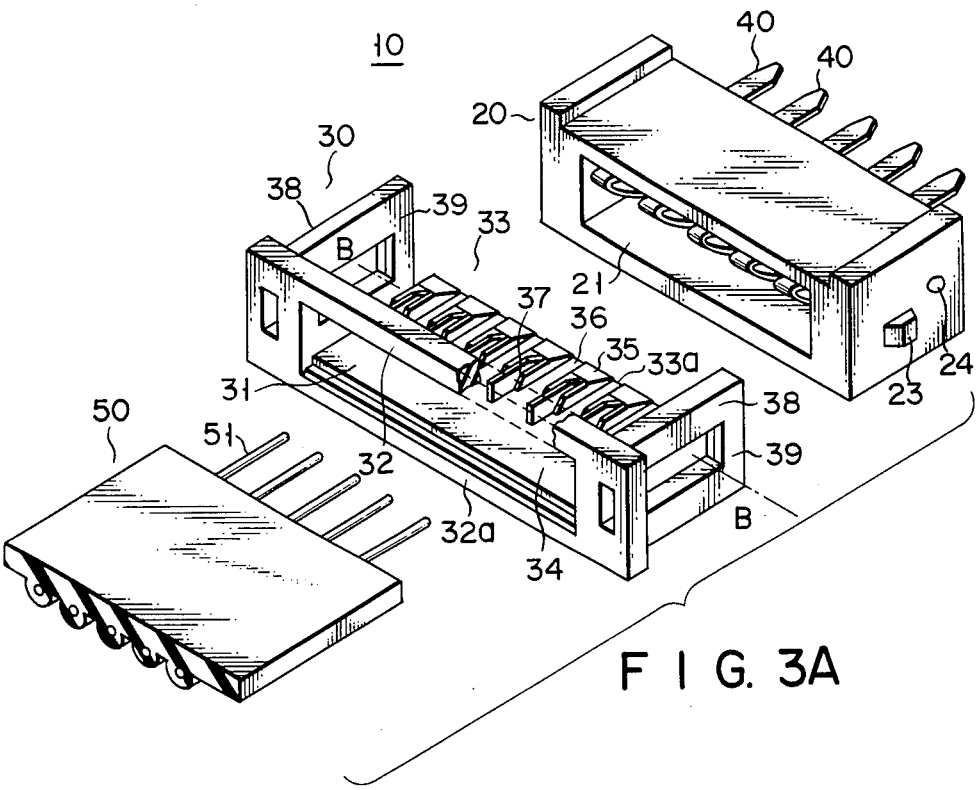
FIG. 3A
FIG. 3B
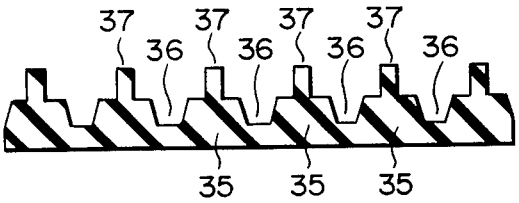
FIG. 4
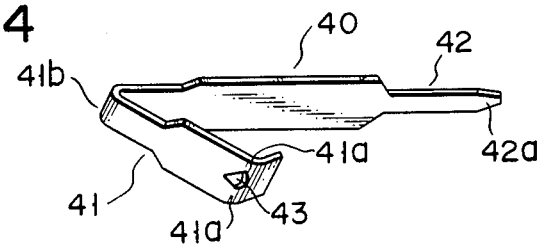

CONNECTOR UNIT

BACKGROUND OF THE INVENTION

This invention relates to a connector unit into which a conductor, such as a flexible cable, is inserted for electrical connection.

FIG. 1 shows one form of a connector unit to which a flexible cable is connected. Flexible cable 70 is comprised of an array of conductors 71 formed on the surface of sheet-like insulation 72 and covered with insulation 73. Where cable 70 is to be connected to connector unit 80, the insulations 72 and 73 are removed at their end portions to expose conductors 71.

Within housing 81 of connector unit 80 an array of connection terminals 82 is placed so that the connection terminals correspond to conductors 71 of cable 70. The respective connection terminal is formed of an elastic metal sheet and has base portion 83, elastic contact portion 84 extending from base portion 83, and pin section 85. Tip portion 84*a* of elastic contact portion 84 abuts against base portion 83 of connection terminal 82. Pin section 85 extends outward from housing 81 and tip portion 85*a* of pin section 85 is inserted into a corresponding through hole of, for example, a printed circuit board.

Where cable 70 is to be connected to connector unit 80, cable conductor 71 is forced into a pressure contact zone between base portion 83 and tip portion 84*a* of elastic contact portion 84 of connection terminal 82. FIG. 2 shows the state in which cable 70 is inserted into connector unit 80. Conductor 71 is urged, under an elastic recovery force of bent portion 84*b* of elastic contact portion 84, toward base portion 83, so that conductor 71 is in elastic contact with connection terminal 82.

Cable 70 is inserted into connector unit 80 such that it causes the pressure contact zone formed between the base portion and the tip portion of the elastic contact portion of connection terminal to be opened aside. Since the conductor pushes tip portion 84*a* of the elastic contact portion of the connection terminal outward upon inserting the cable into connector unit 80, it frictionally contacts tip portion 84*a* of connection terminal 82. As a result, the conductor surface is marred or damaged and, moreover, a strong force is required in order to open tip portion 84*a* of the connection terminal aside. Where the cable has a greater number of conductors to be matingly connected to a corresponding number of connection terminals, then a greater insertion force is necessary due to the sum of individual insertion forces acting in the insertion of the cable into the connector unit. It is difficult to perform such a connector operation efficiently.

SUMMARY OF THE INVENTION

It is accordingly the object of this invention to provide a connector unit which allows a multi-conductor cable to be inserted thereinto, with a smaller insertion force, without marring the respective cable conductors.

According to this invention a connector unit is provided which includes a housing having an opening and connection terminals arranged in the opening, and a movable member made of an insulating material and adapted to be inserted into the opening of the housing. The connection terminals have elastic contact portions to be brought into contact with corresponding conductors, in a direction perpendicular to that in which said conductors are inserted into the opening of the housing. The movable member has cam projections extending in a direction from that end of the movable member at which the movable member is inserted into the housing to the other end of the movable member. The dimension and position of the cam projection being so selected that, when the movable member is partially inserted into the opening of the housing, the cam projection presses the elastic contact portion to provide such a clearance as to allow the conductor to be inserted there and, with the movable member in a fully inserted position, the pressing of the elastic contact portion by the cam projection is released to allow the conductor to be electrically connected to the elastic contact portion.

Thus the conductor can be inserted into the aforementioned clearance without being brought into contact with the elastic contact portion of the connection terminal. Thus, such an insertion operation can be performed with a smaller insertion force, there being no possibility that the conductor will be marred due to the frictional contacting of the conductor with the elastic contact portion of the connection terminal, as encountered in a conventional connector unit.

BRIEF DESCRIPTION OF THE DRAWINGS

FIGS. 3A and 3B show a connector unit according to an embodiment of this invention, FIG. 3A being a perspective view, partly cutaway, and FIG. 3B being a cross-sectional view, taken along line B—B in FIG. 3A;

FIG. 4 is a view showing a connection terminal of the connection unit of FIG. 3;

DETAILED DESCRIPTION OF THE PREFERRED EMBODIMENT

Figure 1:
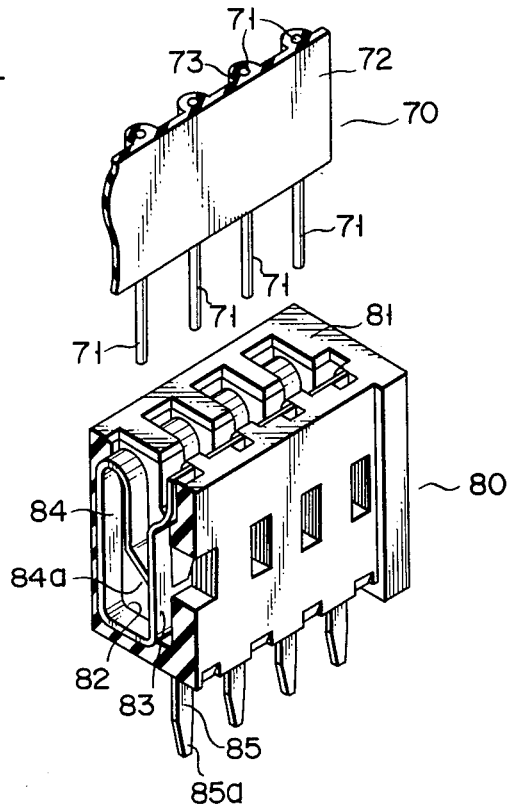
FIG. 1 PRIOR ART
FIGS. 1 and 2 are views for explaining a conventional connector unit.
Figure 2:
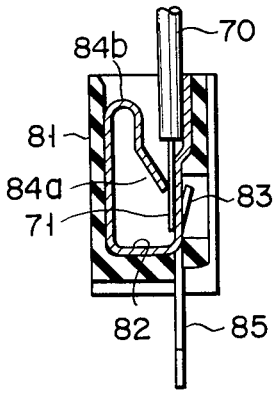
FIG. 2 PRIOR ART

The connector unit according to one embodiment of this invention will now be explained below in greater detail with reference to the accompanying drawings.

FIG. 3A shows connector unit 10, and cable 50 to be connected to the connector unit. The connector unit is comprised of housing 20 and movable member 30.

Housing 20 has opening 21 in which connection terminals 40 are arranged in a parallel array. The connection terminal has V-bent, elastic contact portion 41 at one end portion, as shown expanded in FIG. 4. Elastic contact portion 41 of the connection terminal permits conductors 51 of cable 50 to be pressed in a direction perpendicular to that in which the cable is inserted into housing 20. In this embodiment, the end portion of elastic contact portion 41 of connection terminal 40 is inwardly curved to provide end face 41*a* to be contacted by conductor 51. Pin section 42 is formed at the other end portion of connection terminal 40 and extends beyond housing 20 upon inserting the connection member into the housing. End 42*a* of pin section 42 can be connected to, for example, a printed circuit board.

Movable member 30 includes frame 32 having opening 31 corresponding to opening 21 of housing 20, and main body 33 extending from bottom 32*a* in a direction perpendicular to the frame. Body 33 has such dimensions as to be received into opening 21 of the housing. The body provides flat surface 34 on the side of frame 32. On the surface portion of body 33 to be inserted into housing 20, cam projections 35 are arranged at a predetermined interval and extend from end 33*a* of the movable member located on the side of housing 20, toward frame 32. The bottom surface of an elongated channel between adjacent cam projections 35 is flush with flat surface 34 of body 33. The distance between the adjacent cam projections 35 is selected so as to permit the forward ends of conductors 51 of cable 50 to be located in respective channels 36.

As shown in FIG. 3B, wall 37 is formed on the surface of respective cam projection 35 such that it is higher than the cam projection. When movable member 30 is inserted into housing 20, each wall 37 is located between adjacent connection terminals 40 in the housing to allow connection terminals 40 to be individually isolated one by one, so that respective walls 37 provide partition walls.

Figure 5:
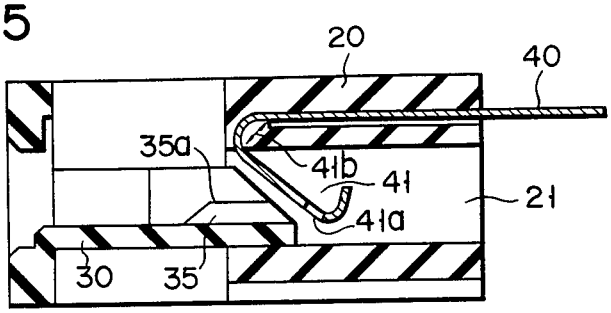
FIGS. 5 and 6 are cross-sectional views showing the connector unit of FIG. 3 with the movable member partially inserted into its housing.

FIG. 5 shows the state in which the forward end portion of movable member 30 is partially inserted into opening 21 of housing 20. As shown in FIG. 5, bending angle 41*b* of elastic contact portion 41 of connection terminal 40 is so selected that, with connection terminal 40 in an unstressed state, end face 41*a* is located at a lower level than upper surface 35*a* of cam projection 35 of the movable member and that, with conductor 51 placed on flat surface 34, end face 41*a* is brought, with sufficient pressure, into contact with the conductor.

Figure 6:
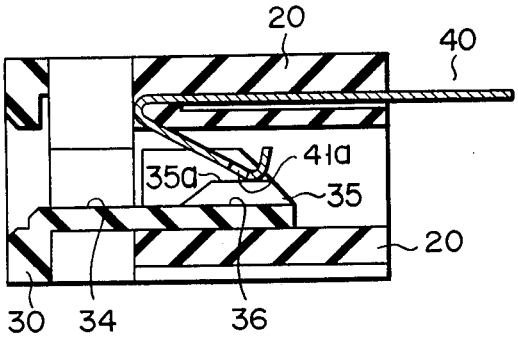
Figure 7:
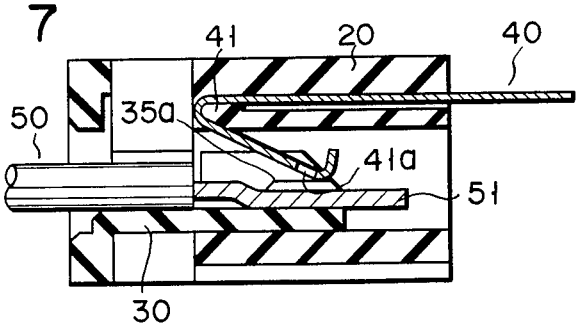
FIG. 7 is a cross-sectional view showing the connector unit in FIG. 6 with a cable inserted thereinto.

Upon further pushing movable member 30 into housing 20, end face 41*a* of elastic contact portion 41 of connection terminal 40 is pushed onto upper surface 35*a* of cam projection 35 of the movable member, as shown in FIG. 6. If, in this state, conductors 51 of cable 50 are inserted into respective channels 36, as shown in FIG. 7, conductors 51 can be inserted below end face 41*a* without contacting the connection terminal at all. Upon further pushing movable member 30 into the housing, upper surface 35*a* of cam projection 35 completely passes under end face 41*a* of elastic contact portion 41 of connection terminal 40. At the same time, end face 41*a* is brought into pressure contact with conductor 51, under an elastic force of the elastic contact portion 41, as shown in FIG. 8, so that conductor 51 is positively in contact with elastic contact portion 41, to assure a positive electrical connection.

Figure 8:
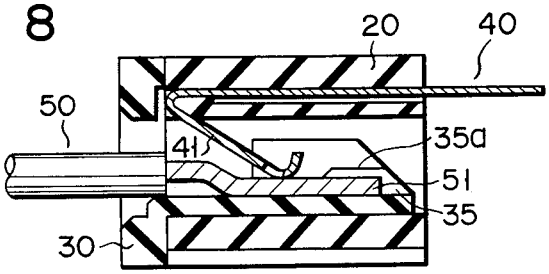
FIG. 8 is a cross-sectional view showing the state in which the movable member is fully inserted into the housing of the connector unit.

Between the completion of insertion of the conductor, as shown in FIG. 7, and the completion of insertion of the movable member, as shown in FIG. 8, conductors 51 are not moved and, when conductor 51 is contacted by elastic contact portion 41, no relative movement between the conductor and the elastic contact portion occurs and thus, there is no friction between the conductor and the elastic contact portion 41 so that the conductors are not marred or damaged. Furthermore, elastic contact portion 41 is pressed inwardly by cam projection 35, leaving sufficient clearance (channel 35 in this embodiment) to allow conductor 51 to be inserted there. As a result, the insertion operation can be effected with a very small pressing force.

Two frames 38 are formed, one each at both end portions of the movable member, and extend as side frames such that they are brought into locking engagement with two projections 23 and 24 of housing 20, to prevent the movable member from being inadvertently removed from the associated housing. That is, one side 39 of rectangular frame 38 which is located closer to the housing is snapfitted at a location between projections 23 and 24, thereby preventing the movable member from being inadvertently removed from the housing and thus fixing the movable member to the housing.

In the aforementioned embodiment, cutout 43 is provided at end face 41*a* to permit conductor 15 of circular cross-section to be pressed by both sides of cutout 43 upon inserting the movable member into the housing. However, the cross-sectional configuration of the conductor, as well as the configuration of the aforementioned contacting area, is not restricted thereto. The conductor to be connected to the connector unit may be not only of a pin type but also of a strand type, and may be of an ordinary type not associated with a flexible cable.

Although in the aforementioned embodiment the cam projection is formed at each side of channel 36 for conductor 51, it may be formed at one side only. Although in the aforementioned embodiment a clearance for inserting the conductor has been explained as constituting a channel between the adjacent cam projections, it is not restricted thereto. For example, a respective cam projection may be located right beneath a corresponding connection terminal, in which case a tunnellike passage is formed in the cam projection, so that the conductor may be inserted into the tunnel-like passage with the elastic contact portion of the connection terminal in contact with the surface of the cam projection.

What is claimed is:

1. A connector unit comprising:

a housing having an opening and connection terminal arranged in the opening, and a movable member made of an insulating material and adapted to be inserted into the opening of the housing, in which said connection terminal has an elastic contact portion to be brought into contact with a corresponding conductor in a direction perpendicular to that in which said conductor is inserted into the opening of the housing, and said movable member has cam projections extending in a direction from that end of the movable member at which the movable member is inserted into the housing, to the other end of said movable member, the dimensions and position of the cam projection being so selected that, when the movable member is partially inserted into the opening of the housing, the cam projection presses the elastic contact portion to provide such a clearance as to allow the conductor to be inserted there and, with the movable member in a fully inserted position, the pressing of the elastic contact portion by the cam projection is released to allow the conductor to be electrically connected to the elastic contact portion.

* * * * *